US009076392B2

(12) United States Patent
Umezaki et al.

(10) Patent No.: US 9,076,392 B2
(45) Date of Patent: Jul. 7, 2015

(54) DISPLAY DEVICE AND DRIVING METHOD THEREOF

(75) Inventors: Atsushi Umezaki, Kanagawa (JP); Satohiro Okamoto, Shizuoka (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 548 days.

(21) Appl. No.: 12/877,689

(22) Filed: Sep. 8, 2010

(65) Prior Publication Data

US 2011/0063340 A1 Mar. 17, 2011

(30) Foreign Application Priority Data

Sep. 16, 2009 (JP) ..... 2009-214963

(51) Int. Cl.
*G09G 5/10* (2006.01)
*G09G 3/34* (2006.01)

(52) U.S. Cl.
CPC ..... *G09G 3/344* (2013.01); *G09G 2310/061* (2013.01)

(58) Field of Classification Search
CPC ..... G09G 3/344; G09G 2310/061
USPC ..... 345/107, 214; 257/359
See application file for complete search history.

(56) References Cited

U.S. PATENT DOCUMENTS

| | | | | |
|---|---|---|---|---|
| 5,349,366 | A | 9/1994 | Yamazaki et al. | |
| 6,650,462 | B2 | 11/2003 | Katase | |
| 6,774,884 | B2 | 8/2004 | Shimoda et al. | |
| 7,019,889 | B2 | 3/2006 | Katase | |
| 7,336,249 | B2 | 2/2008 | Hirakata et al. | |
| 7,359,110 | B2 | 4/2008 | Katase | |
| 7,605,899 | B2 | 10/2009 | Shikina et al. | |
| 8,178,926 | B2 * | 5/2012 | Nakayama | 257/359 |
| 8,179,387 | B2 | 5/2012 | Shin et al. | |
| 8,264,454 | B2 * | 9/2012 | Kim et al. | 345/107 |
| 2006/0050050 | A1 * | 3/2006 | Zhou et al. | 345/107 |

(Continued)

FOREIGN PATENT DOCUMENTS

| | | | |
|---|---|---|---|
| CN | 101051130 | A | 10/2007 |
| JP | 2002-169190 | A | 6/2002 |

(Continued)

OTHER PUBLICATIONS

Chinese Office Action (Application No. 201010293505.3) Dated Mar. 10, 2014.

*Primary Examiner* — Kumar Patel
*Assistant Examiner* — Kuo Woo
(74) *Attorney, Agent, or Firm* — Fish & Richardson P.C.

(57) ABSTRACT

A new driving method of a display device that makes it possible to reduce power consumption and to improve display quality is proposed. A first gray scale is displayed in all pixels in a first initialization period, a second gray scale is displayed in all the pixels in a second initialization period, an objective image is displayed in a writing period, and the image is held in a holding period. Alternatively, an electrical history of a gray scale storage display element for displaying a number of gray scales is erased in the first initialization period and the second initialization period. Alternatively, a potential of a common electrode is changed in the first initialization period, the second initialization period, the writing period, and the holding period. Alternatively, a potential of a capacitor wiring is changed in synchronization with the potential of the common electrode.

18 Claims, 10 Drawing Sheets

(56) References Cited

U.S. PATENT DOCUMENTS

| | | | | |
|---|---|---|---|---|
| 2006/0192751 | A1 | 8/2006 | Miyasaka et al. | |
| 2006/0209011 | A1* | 9/2006 | Miyasaka | 345/107 |
| 2007/0040104 | A1 | 2/2007 | Miyazawa | |
| 2008/0074357 | A1 | 3/2008 | Kanda | |
| 2008/0198116 | A1 | 8/2008 | Kim | |
| 2008/0237598 | A1 | 10/2008 | Nakayama | |
| 2009/0058797 | A1* | 3/2009 | Hirayama | 345/107 |
| 2009/0237392 | A1* | 9/2009 | Kajino | 345/214 |
| 2009/0251456 | A1 | 10/2009 | Koyama | |
| 2011/0063339 | A1 | 3/2011 | Umezaki et al. | |

FOREIGN PATENT DOCUMENTS

| | | | |
|---|---|---|---|
| JP | 2003-131621 | A | 5/2003 |
| JP | 2007-206471 | A | 8/2007 |
| JP | 2008-152230 | A | 7/2008 |
| JP | 2008-242383 | A | 10/2008 |
| WO | WO-2005/055187 | | 6/2005 |

* cited by examiner

First
initialization period
First
period
Second
period
t
t

Vh
Vl

Vh
Vl

Vh
Vl

Vh
Vl

Writing period
First period
Second period
t
t

Vh
Vl

Vh
Vl

Vh
Vl

First
initialization period
First
period
Second
period
Third
period
t
2t
4t

Vh
Vl

Vh
Vl

Vh
Vl

Vh
Vl

Vh
Vl

DISPLAY DEVICE AND DRIVING METHOD THEREOF

BACKGROUND OF THE INVENTION

1. Field of the Invention

One embodiment of the present invention relates to a driving method of a display device including a gray scale storage display element such as an electrophoretic element, or a display device using the driving method.

2. Description of the Related Art

As a display device capable of being driven at low power, a display device including an electrophoretic element has attracted attention. The electrophoretic element is based on the principle that charged particles move due to an electric field, and can hold an image for an extremely long time as long as an electric field is not generated. Therefore, the display device including an electrophoretic element has been expected as display devices for displaying still images such as an electronic book and a poster.

Since the display device including an electrophoretic element is quite promising as a low power consumption display device as described above, various structures have been proposed so far. For example, like a liquid crystal display device or the like, an active matrix display device in which a transistor is used as a switching element of a pixel has been proposed (for example, see Patent Document 1).

Additionally, various methods for driving a display device including an electrophoretic element have been proposed. For example, a method has been proposed by which, in switching images, the entire surface of a display portion is changed to a first gray scale (e.g., white), and then changed to a second gray scale (e.g., black), and then, an objective image is displayed (for example, see Patent Document 2).

REFERENCE

[Patent Document 1] Japanese Published Patent Application No. 2002-169190

[Patent Document 2] Japanese Published Patent Application No. 2007-206471

SUMMARY OF THE INVENTION

However, the above driving method can display only two gray scales of black and white and cannot display a number of gray scales. Therefore, it is hard to say that the above method is appropriate for a display device which needs to display a number of gray scales (e.g., a full-color display device including a gray scale storage display element).

Additionally, in a display device for displaying a number of gray scales, slight display disorder reduces the image quality significantly. Thus, the problem of afterimage is more severe than that of a display device for displaying two gray scales.

Further, in order to display a number of gray scales, it is necessary to adopt a complex driving method, so that power consumption tends to be increased. Thus, further reduction in power consumption is necessary for the display device including a gray scale storage display element.

In view of the above problems and the like, it is one object of one embodiment of the disclosed invention to propose a new driving method of a display device in which power consumption is reduced and display quality is improved. Alternatively, one object is to provide a display device in which the new driving method is used.

In one embodiment of the disclosed invention, a first gray scale is displayed in all pixels in a first initialization period, a second gray scale is displayed in all the pixels in a second initialization period, an objective image is displayed in a writing period, and the image is held in a holding period. Alternatively, an electrical history of a gray scale storage display element for displaying a number of gray scales is erased in the first initialization period and the second initialization period. Alternatively, a potential of a common electrode is changed in the first initialization period, the second initialization period, the writing period, and the holding period. Alternatively, a potential of a capacitor wiring is changed in synchronization with the potential of the common electrode.

An example of further details will be described below.

According to one embodiment of the disclosed invention, a driving method of a display device includes the steps of: displaying a first gray scale by a gray scale storage display element by application of a first potential or a second potential to a pixel electrode and application of the second potential to a common electrode, and applying a third potential to a capacitor wiring electrically connected to the pixel electrode through a capacitor; displaying a second gray scale by the gray scale storage display element by application of the first potential or the second potential to the pixel electrode and application of the first potential to the common electrode, and applying a fourth potential to the capacitor wiring; displaying a predetermined gray scale by the gray scale storage display element by application of the first potential or the second potential to the pixel electrode and application of the second potential to the common electrode, and applying the third potential to the capacitor wiring; and holding the predetermined gray scale by the gray scale storage display element by application of the first potential or the second potential to the common electrode and application of a potential which is equal to the potential applied to the common electrode to the pixel electrode, and applying the fourth potential or the third potential to the capacitor wiring, so that a predetermined image is displayed.

According to another embodiment of the disclosed invention, a driving method of a display device includes the steps of: displaying a first gray scale by a gray scale storage display element by application of a first potential or a second potential to a pixel electrode and application of the second potential to a common electrode, and applying a third potential to a capacitor wiring electrically connected to the pixel electrode through a capacitor; displaying a second gray scale by the gray scale storage display element by application of the second potential to the pixel electrode and application of the first potential to the common electrode, and applying a fourth potential to the capacitor wiring; displaying a predetermined gray scale by the gray scale storage display element by application of the first potential or the second potential to the pixel electrode and application of the second potential to the common electrode, and applying the third potential to the capacitor wiring; and holding the predetermined gray scale by the gray scale storage display element by application of the first potential or the second potential to the common electrode and application of a potential which is equal to the potential applied to the common electrode to the pixel electrode, and applying the fourth potential or the third potential to the capacitor wiring, so that a predetermined image is displayed.

In the above driving method, the third potential or the fourth potential is preferably applied to the capacitor wiring so that a difference between a potential of the pixel electrode and a potential of the capacitor wiring is equal to a difference between the potential of the pixel electrode and a potential of the common electrode. Additionally, the third potential may be equal to the second potential, and the fourth potential may be equal to the first potential. That is, a difference between the first potential and the second potential may be equal to a difference between the third potential and the fourth potential. Note that expressions such as "equal" and "the same" in this specification or the like include the case where there is difference within the margin of error. For example, an expression "potentials (or potential differences) are equal" includes the case where a margin with at least ±5% is included as the margin of error.

Additionally, in the above driving method, the first gray scale is preferably displayed by the gray scale storage display element by control of the length of a period during which the first potential is applied to the pixel electrode in response to the gray scale held in the gray scale storage display element in order to display an image which is displayed before a predetermined image.

Additionally, in the above driving method, the predetermined gray scale is preferably displayed by the gray scale storage display element by control of the length of a period for applying the first potential to the pixel electrode and the length of a period for applying the second potential to the pixel electrode.

Additionally, in the above driving method, the first gray scale is preferably set to a gray scale with which the brightness of the gray scale storage display element is one of the maximum brightness or the minimum brightness, and the second gray scale is preferably set to a gray scale with which the brightness of the gray scale storage display element is the other of the maximum brightness or the minimum brightness.

According to another embodiment of the disclosed invention, a display device which employs the above driving method and includes a transistor formed using an oxide semiconductor material as an element for controlling a potential applied to the pixel electrode. Note that the oxide semiconductor material is preferably an In—Ga—Zn—O-based amorphous oxide semiconductor material.

Note that, in this specification and the like, a gray scale storage display element is referred to as a display element capable of controlling a gray scale which is to be displayed by application of a potential difference (application of voltage) to the element and capable of holding the gray scale which is to be displayed without application of a potential difference (without application of voltage) to the element. As the gray scale storage display element, an electrophoretic element, a particle rotation type element, a particle transfer type element, a magnetophoretic element, a liquid transfer type element, a light-scattering element, a phase-change element, or the like can be used.

According to one embodiment of the disclosed invention, the power consumption of a display device can be reduced and the display quality of the display device can be improved.

DETAILED DESCRIPTION OF THE INVENTION

Figure 1A:
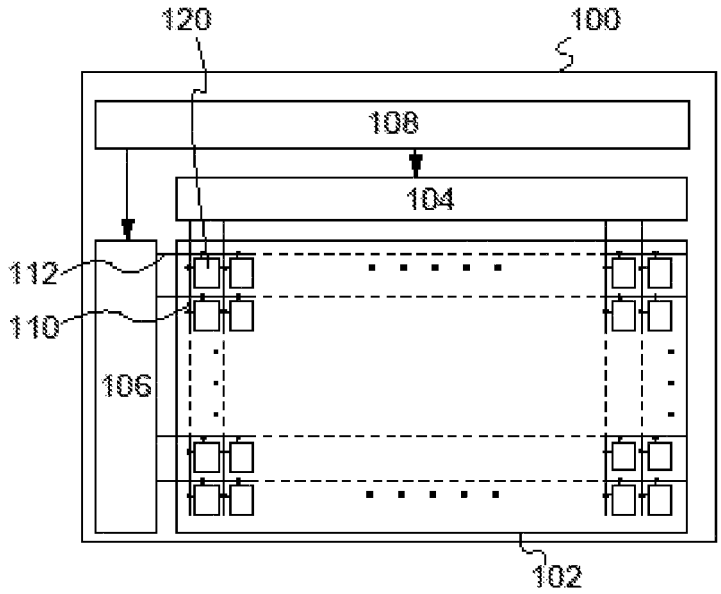
FIGS. 1A to 1C are diagrams each showing a structural example of a display device.

Hereinafter, embodiments are described in detail with reference to the accompanying drawings. However, the present invention is not limited to the following description in the embodiments, and it will be easily understood by those skilled in the art that various changes and modifications of modes and details of the present invention can be made without departing from the spirit of the present invention. Structures of different embodiments can be implemented in combination as appropriate. Note that, in the structures of the present invention described below, the same portions or portions having similar functions are denoted by the same reference numerals and the description thereof is not repeated.

Note that, in the following embodiments, a case where an electrophoretic element is used as a gray scale storage display element is described as an example.

Embodiment 1

In this embodiment, a display device in which a gray scale storage display element is used which is one embodiment of the disclosed invention and the operation (the driving method) thereof will be described with reference to FIGS. 1A to 1C, FIGS. 2A and 2B, FIGS. 3A to 3D, and FIGS. 4A to 4C.

Structural Example

FIG. 1A shows a structural block diagram of a display device of this embodiment. A display device 100 includes a pixel portion 102, a source driver 104, a gate driver 106, a controller portion 108, m (m is a positive integer) pieces of source lines 110 (source lines $\mathbf{110}_1$ to $\mathbf{110}_m$) which are arranged roughly parallel to each other, and n (n is a positive integer) pieces of gate lines 112 (gate lines $\mathbf{112}_1$ to $\mathbf{112}_n$) which are arranged roughly parallel to each other. The source driver 104 is electrically connected to the pixel portion 102 through the m pieces of source lines 110. The gate driver 106 is electrically connected to the pixel portion 102 through the n pieces of gate lines 112. Additionally, the controller portion 108 is electrically connected to the source driver 104 and the gate driver 106.

Further, the pixel portion 102 includes n×m pieces of pixels 120 (pixels $\mathbf{120}_{11}$ to $\mathbf{120}_{nm}$). Note that the pixels 120 are arranged in n rows and m columns. In addition, each of the m pieces of source lines 110 is electrically connected to n pieces of pixels which are arranged in a column, and each of the n pieces of gate lines 112 is electrically connected to m pieces of pixels which are arranged in a row. In other words, a pixel $\mathbf{120}_{ij}$ in an i-th row and a j-th column (i and j are each a positive integer: $1 \le i \le n$ and $1 \le j \le m$) is electrically connected to a source line $\mathbf{110}_j$ and a gate line $\mathbf{112}_i$.

Figure 1B:
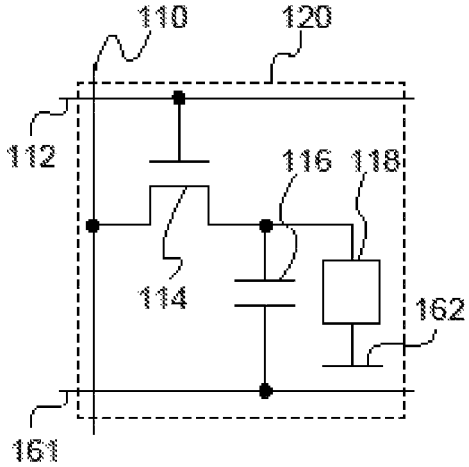

FIG. 1B shows a circuit diagram of the pixel 120 included in the display device. The pixel 120 includes at least the source line 110, the gate line 112, a transistor 114, a capacitor 116, and an electrophoretic element 118. A gate terminal of the transistor 114 is electrically connected to the gate line 112; a first terminal (also referred to as a source terminal for convenience) of the transistor 114 is electrically connected to the source line 110; and a second terminal (also referred to as a drain terminal for convenience) of the transistor 114 is electrically connected to a first terminal of the capacitor 116 and a first terminal (also referred to as a pixel electrode for convenience) of the electrophoretic element 118. In addition, a second terminal of the capacitor 116 is electrically connected to a wiring 161 (also referred to as a capacitor wiring for convenience) to which a predetermined potential is applied. In addition, a second terminal of the electrophoretic element 118 (also referred to as a common electrode for convenience) is electrically connected to a wiring 162 (also referred to as a common potential line for convenience) to which a common potential is applied.

Note that the display device is formed using a plurality of pixels. The other pixels have the same structure as the pixel 120. In addition, these terms such as "source" and "drain" are used just for convenience and do not determine their functions.

Figure 1C:
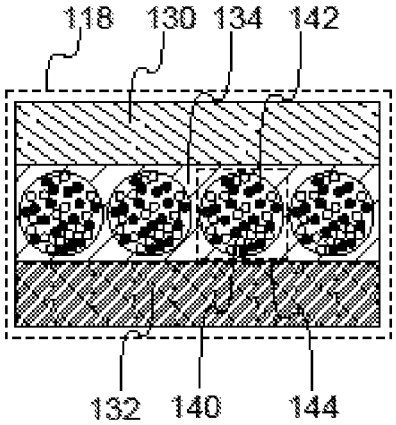

The structure of the electrophoretic element 118 is shown in FIG. 1C. The electrophoretic element 118 includes at least an electrode 130, an electrode 132, and a layer 134 which contains charged particles between the electrode 130 and the electrode 132. Here, one of the electrode 130 and the electrode 132 corresponds to the first terminal (the pixel electrode) of the electrophoretic element 118, and the other of the electrode 130 and the electrode 132 corresponds to the second terminal (the common electrode) of the electrophoretic element 118. In addition, one of the electrode 130 and the electrode 132 is formed using a light-transmitting material. The layer 134 containing charged particles includes a microcapsule 144 containing white particles 140 charged either positively or negatively and black particles 142 charged either positively or negatively, which have polarity opposite to that of the white particles 140. The white particles 140 and the black particles 142 can move in the microcapsule 144.

In the electrophoretic element 118, arrangement of the white particles 140 and the black particles 142 in the microcapsule 144 can be changed by control of potentials of the electrode 130 and the electrode 132; accordingly, the brightness of the electrophoretic element 118 which is seen from the outside can be changed. For example, the white particles 140 are gathered around the electrode formed using a light-transmitting material; thus, high brightness (e.g., white) is recognizable. Alternatively, the black particles 142 are gathered around the electrode formed using a light-transmitting material; thus, a state of low brightness (e.g., black) is recognizable.

Note that the brightness of the electrophoretic element 118 may be changed in two stages (that is, two gray scales are displayed), or in multiple stages (that is, a number of gray scales are displayed). In the case where the brightness of the electrophoretic element 118 is changed in two stages, for example, two different brightness such as black and white (hereinafter just referred to as a gray scale) can be expressed. On the other hand, in the case where the brightness of the electrophoretic element 118 is changed in multiple stages, a number of gray scales including an intermediate color (e.g., gray) can be expressed.

Note that although the case where an electrophoretic element is used as an example of a gray scale storage display element in this embodiment, other gray scale storage display element may be used. As examples of other gray scale storage display element, there are a particle rotation type element using a twist ball, a particle transfer type element using a charged toner or Electronic Liquid Powder (registered trademark), a magnetophoretic element in which gradation is expressed by magnetism, a liquid transfer type element, a light-scattering element, a phase-change element, and the like.

(General Operation)

Next, the general operation is described. A signal is input to the electrophoretic element 118 in such a manner that potentials applied to the common electrode and the pixel electrode are controlled. Specifically, a potential of the common electrode is controlled by control of a potential of the common potential line, and a potential of the pixel electrode electrically connected to the source line 110 through the transistor 114 is controlled by control of a signal from the source driver 104. Note that a signal is input to the pixel electrode in such a manner that one of the gate lines 112 is selected and the transistor 114 is turned on.

In the display device of the disclosed invention, two kinds of potentials, each of which is high or low (a first potential and a second potential), are selectively applied to the common electrode and the pixel electrode. For example, $V_h$ is applied to the common electrode and $V_1$ ($V_1<V_h$) is applied to the pixel electrode in the case where a potential difference (hereinafter also simply referred to as voltage) which makes the potential of the common electrode high is applied to the electrophoretic element 118. In addition, $V_1$ is applied to the common electrode and $V_h$ is applied to the pixel electrode in the case where a potential difference (voltage) which makes the potential of the pixel electrode high is applied to the electrophoretic element 118. Additionally, the common electrode and the pixel electrode have the same potential in the case where a potential difference is not applied to the electrophoretic element 118. That is, either $V_1$ or $V_h$ is applied to the common electrode and the pixel electrode. Note that potentials applied to the common electrode and the pixel electrode are not strictly limited to the above two kinds of potentials, and have a margin of error (e.g., a margin of ±5%).

In this manner, the difference generated between the potential of the common electrode and the potential of the pixel electrode produces an electric field in the layer 134 containing charged particles. Then, the arrangement of the white particles 140 and the black particles 142 in the electrophoretic element 118 is changed, whereby the gray scales can be changed. In addition, the gray scales can be held without generation of a difference between a potential of the common electrode and a potential of the pixel electrode.

In the display device of the disclosed invention, gray scales that the electrophoretic element 118 displays are controlled by changing the length of a time during which the electric field is generated (a time during which a potential difference is generated). Therefore, voltage generated in the electrophoretic element 118 may be only two kinds: $V_h-V_1$ and $V_1-V_h$ in principle. Note that gray scales are displayed in such a manner that a unit time t, which is the shortest time during which voltage is generated, is used as normal.

Note that the gray scales can also be controlled by intensity of the electric field generated in the layer 134 containing charged particles.

Next, the operation of the display device 100 is described in such a manner that the operation is divided into periods each corresponding to the function of the display device 100. The operation of the display device 100 can be described by being divided into a rewriting period for rewriting image and a holding period for holding the image (see FIG. 2A). The rewriting period is divided into three periods: a first initialization period for displaying a first gray scale by the electrophoretic element 118 in the pixel 120, a second initialization period for displaying a second gray scale, and a writing period for displaying a predetermined gray scale. Here, the first initialization period and the second initialization period are periods for erasing an electrical history of the electrophoretic element 118 and reducing afterimages of the display device. In addition, the first gray scale and the second gray scale are each a gray scale which makes the brightness of the electrophoretic element 118 either the highest or the lowest.

Note that, as described in this embodiment, application of either the first potential or the second potential to the common electrode makes it possible to reduce power consumption as compared with the case where the potential of the common electrode is fixed. For example, it is possible to adopt a structure in which $V_h$ is applied in the first initialization period; $V_1$, in the second initialization period; $V_h$, in the writing period; and $V_1$, in the holding period (see FIG. 2B). Needless to say, a potential applied to the common electrode is not limited to the potential shown in FIG. 2B. A structure may be adopted in which $V_1$ is applied in the first initialization period; $V_h$, in the second initialization period; $V_1$, in the writing period; and $V_h$, in the holding period. In addition, a potential applied in the holding period may be the same as a potential applied in the writing period or the first initialization period.

In the display device shown in this embodiment, the potential of the pixel electrode is changed between $V_1$ and $V_h$. In other words, the amount of potential change in the pixel electrode is V ($=V_h-V_1$). On the other hand, in the case where similar operation is performed with the potential of the common electrode fixed, the amount of potential change in the pixel electrode is 2V when the potential of the common electrode is normal (0). In this manner, the amount of potential change in the pixel electrode is reduced by half in the case where the potential of the common electrode is changed as compared with the case where the potential of the common electrode is fixed. Therefore, a load on the source driver 104 can be reduced and the power consumption of the display device can be reduced.

Note that as described in this embodiment, it is preferable that a potential of the capacitor wiring connected to the second terminal of the capacitor 116 is changed in synchronization with the potential of the common electrode in the case where the potential of the common electrode is changed. Specifically, a potential is applied to the capacitor wiring so that a difference between the potential of the pixel electrode and the potential of the capacitor wiring is equal to a difference between the potential of the pixel electrode and the potential of the common electrode. Accordingly, a signal is favorably held by the capacitor 116, whereby display disorder which may be caused due to a potential change of the common electrode can be suppressed. Note that a method where the common electrode and the capacitor wiring are electrically connected to each other or the like can be used as a method for making a difference between the potential of the pixel electrode and the potential of the capacitor wiring equal to a difference between the potential of the pixel electrode and the potential of the common electrode.

A case of displaying a first gray scale (white) with high brightness, a third gray scale (black) with low brightness, and a second gray scale (gray) with intermediate brightness between the first gray scale (white) and the third gray scale (black) is described below as an example. Here, a gray scale displayed in a state of displaying the first gray scale (white) by application of $V_h$ to the common electrode and application of $V_1$ to the pixel electrode during the unit time t is referred to as the second gray scale (gray). In addition, a gray scale displayed in a state of displaying the first gray scale (white) by application of $V_h$ to the common electrode and application of $V_1$ to the pixel electrode during the unit times 2*t* is referred to as the third gray scale (black). In addition, a gray scale displayed in a state of displaying the second gray scale (gray) by application of $V_h$ to the common electrode and application of $V_1$ to the pixel electrode during the unit time t is referred to as the third gray scale (black). In addition, the relation of the potentials of the common electrode and the pixel electrode is exchanged, whereby the first gray scale (white) can be displayed from a state of the third gray scale (black) or the second gray scale (gray).

Additionally, the first gradation displayed in the first initialization period is described below as the third gray scale (black), and the second gradation displayed in the second initialization period is described below as the first gray scale (white).

(First Initialization Operation)

In the first initialization period, the third gray scale (black) is displayed by the electrophoretic element 118. Here, an image has already been displayed on the pixel portion 102 before the first initialization operation. That is, the electrophoretic elements 118 for displaying the first gray scale (white), the second gray scale (gray), and the third gray scale (black) are mixed in the pixel portion 102.

Thus, in the display device of the disclosed invention, an input signal in the first initialization period is varied in accordance with a gray scale that the electrophoretic element 118 has already displayed. This is because afterimages due to excessive signal application can be suppressed and the power consumption can be reduced with such a structure. Note that in the first initialization period, it is necessary to accommodate three gray scales: the first gray scale (white), the second gray scale (gray), and the third gray scale (black); therefore, a signal is input with the first initialization period divided into two periods each of which is the unit time t.

Figures 3A, 3B, 3C, 3D:
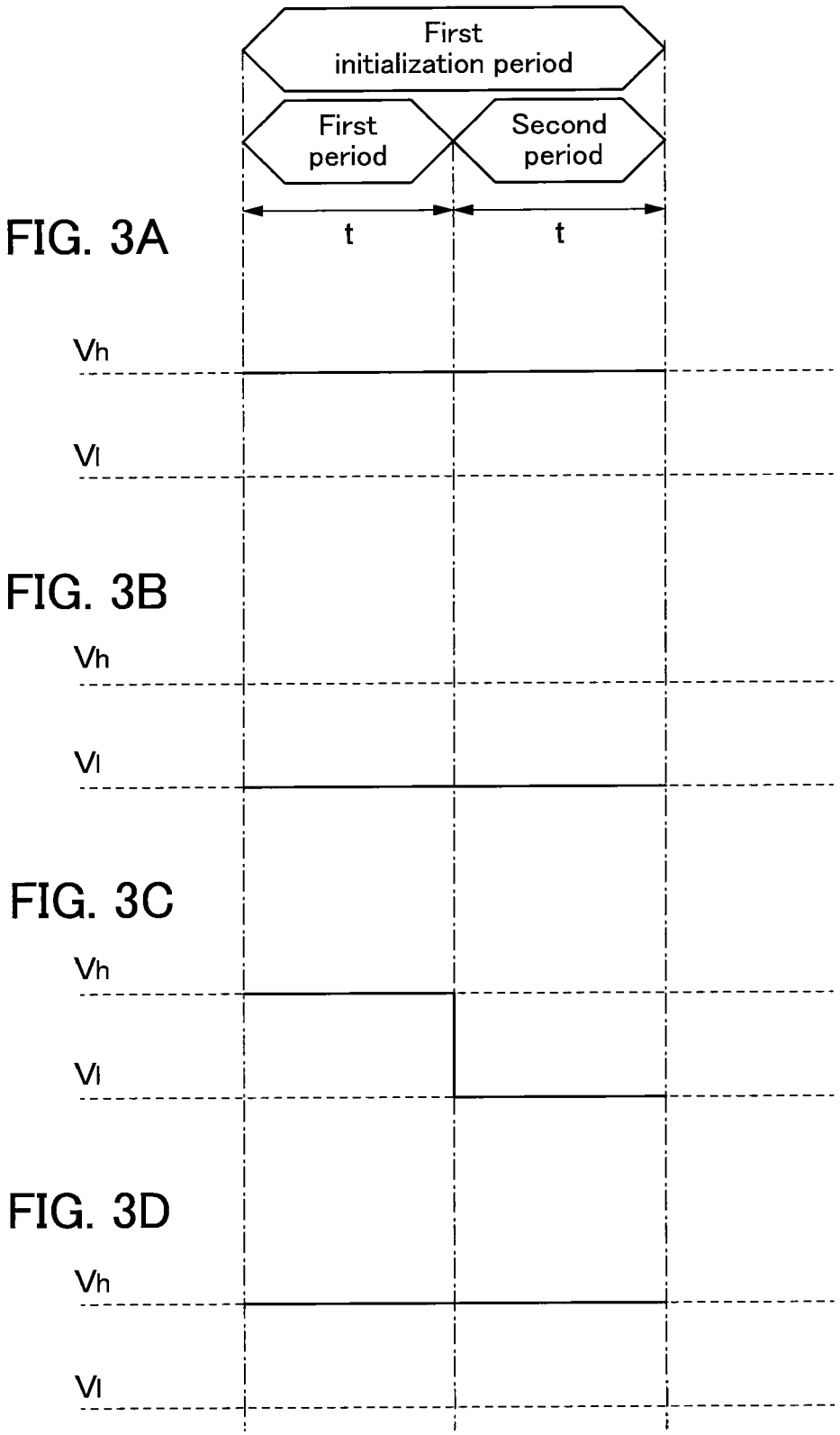
FIGS. 3A to 3D are diagrams each showing an example of an input potential in a first initialization period.

The potential of the common electrode in the first initialization period is shown in FIG. 3A, and patterns of a potential input to the pixel electrode in the first initialization period are shown in FIGS. 3B to 3D. In the first initialization period, an object is to display the third gray scale (black) by the electrophoretic element 118; therefore, the potential of the common electrode is fixed to $V_h$, as shown in FIG. 3A.

FIG. 3B shows a pattern of a potential of the pixel electrode in the case where a gray scale that the electrophoretic element 118 has already displayed is the first gray scale (white). A potential input to the pixel electrode is set to $V_1$ in both a first period and a second period, whereby a signal of $V_1-V_h$ is input during the unit times 2*t*; therefore, the third gray scale (black) is displayed by the electrophoretic element 118.

FIG. 3C shows a pattern of a potential of the pixel electrode in the case where a gray scale that the electrophoretic element 118 has already displayed is the second gray scale (gray). A potential input to the pixel electrode is set to $V_h$ in either one of the first period or the second period; and $V_1$, in the other period, whereby a signal of $V_1-V_h$ is input during the unit time t; therefore, the third gray scale (black) is displayed by the electrophoretic element 118. Note that although the potential input to the pixel electrode is $V_h$ in the first period and is $V_1$ in the second period in FIG. 3C, the potential may be $V_1$ in the first period and may be $V_h$ in the second period.

FIG. 3D shows a pattern of a potential input to the pixel electrode in the case where a gray scale that the electrophoretic element 118 has already displayed is the third gray scale (black). A potential input to the pixel electrode is set to $V_h$ in both the first period and the second period, whereby a signal is not substantially input to the electrophoretic element 118; therefore, the third gray scale (black) is held without change.

(Second Initialization Operation)

In the second initialization period, the first gray scale (white) is displayed by the electrophoretic element 118. Here, the third gray scale (black) is displayed by the electrophoretic element 118 in the pixel portion 102 before the second initialization operation. Thus, the potential of the common electrode may be fixed to $V_1$, and the potential of the pixel electrode may be fixed to $V_h$ in the second initialization period.

Note that the third gray scale (black) has already been displayed by the electrophoretic element 118; thus, the first gray scale (white) can be displayed by application of $V_1$ to the common electrode and application of $V_h$ to the pixel electrode during the unit times 2*t*. In this manner, in the second initialization period, it is not necessary to vary signals supplied to the electrophoretic element 118; therefore, it is also not necessary to divide the second initialization period into two periods each of which is the unit time t.

With the above initialization operation, the electrical history of the electrophoretic element 118 can be erased. In this manner, afterimages of the display device 100 can be reduced.

Note that although in the above display device, the potential of the common electrode is fixed to $V_1$ and a potential of the pixel electrode is fixed to $V_h$, the potential of the common electrode can be fixed to $V_1$ and $V_1$ or $V_h$ can be selectively input to the pixel electrode in the case where a method for displaying an intermediate color through the second initialization operation is adopted.

(Writing Period)

In the writing period, the first gray scale (white), the second gray scale (gray), and the third gray scale (black) are displayed by the electrophoretic element 118, whereby an objective image is formed. Here, the first gray scale (white) is displayed by the electrophoretic element 118 in the pixel portion 102 before the writing operation. Thus, in the writing period, an objective gray scale is displayed by fixing the potential of the common electrode to $V_h$ and changing a potential of the pixel electrode.

In addition, in the writing period, it is necessary to accommodate three gray scales: the first gray scale (white), the second gray scale (gray), and the third gray scale (black); therefore, a signal is input in such a manner that the writing period is divided into two periods each of which is the unit time t.

Figures 4A, 4B, 4C:
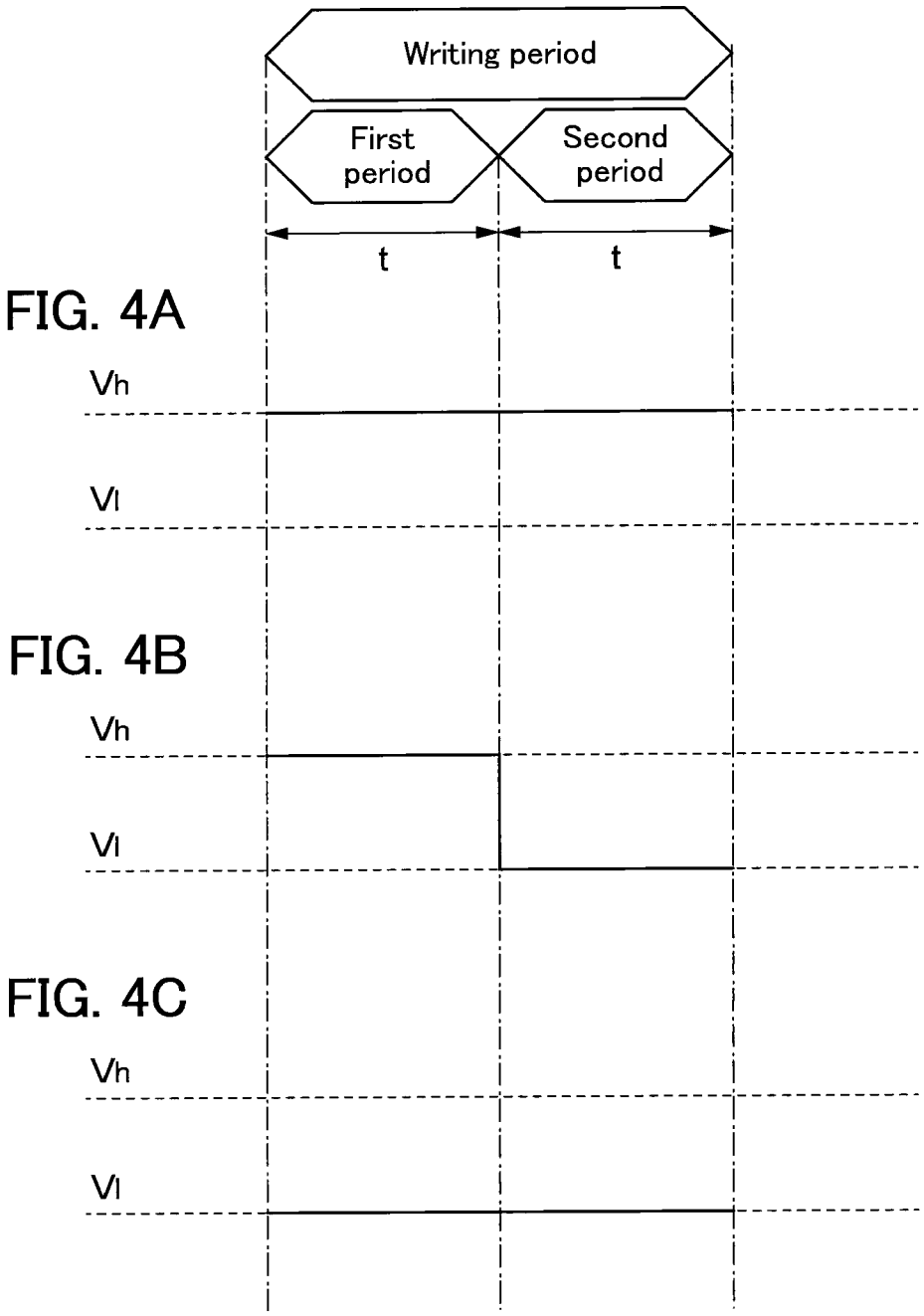
FIGS. 4A to 4C are diagrams each showing an example of an input potential in a writing period.

For example, in the case where the first gray scale (white) is displayed, a potential input to the pixel electrode is $V_h$ in both a first period and a second period (see FIG. 4A). Thus, a signal is not substantially input to the electrophoretic element 118; therefore, the first gray scale (white) is held without change.

In the case where the second gray scale (gray) is displayed, a potential input to the pixel electrode is $V_h$ in either one of the first period or the second period; and $V_1$, in the other period (see FIG. 4B). Thus, a signal of $V_h$–$V_1$ is input during the unit time t; therefore, the second gray scale (gray) is displayed by the electrophoretic element 118. Note that although the potential input to the pixel electrode is $V_h$ in the first period and the potential is $V_1$, in the period 2 in FIG. 4B, $V_1$ may be input in the first period and $V_h$ may be input in the second period.

In the case where the third gray scale (black) is displayed, a potential input to the pixel electrode is $V_1$ in both the first period and the second period (see FIG. 4C). Thus, a signal of $V_h$–$V_1$ is input during the unit times 2*t*; therefore, the third gray scale (black) is displayed by the electrophoretic element 118.

(Holding Period)

In the holding period, an objective image is displayed in such a manner that the gray scale displayed in the writing period is held by the electrophoretic element 118. In the holding period, it is necessary to hold the gray scale which has been already displayed; therefore, a signal is not substantially input to the electrophoretic element 118.

Figures 2A, 2B:
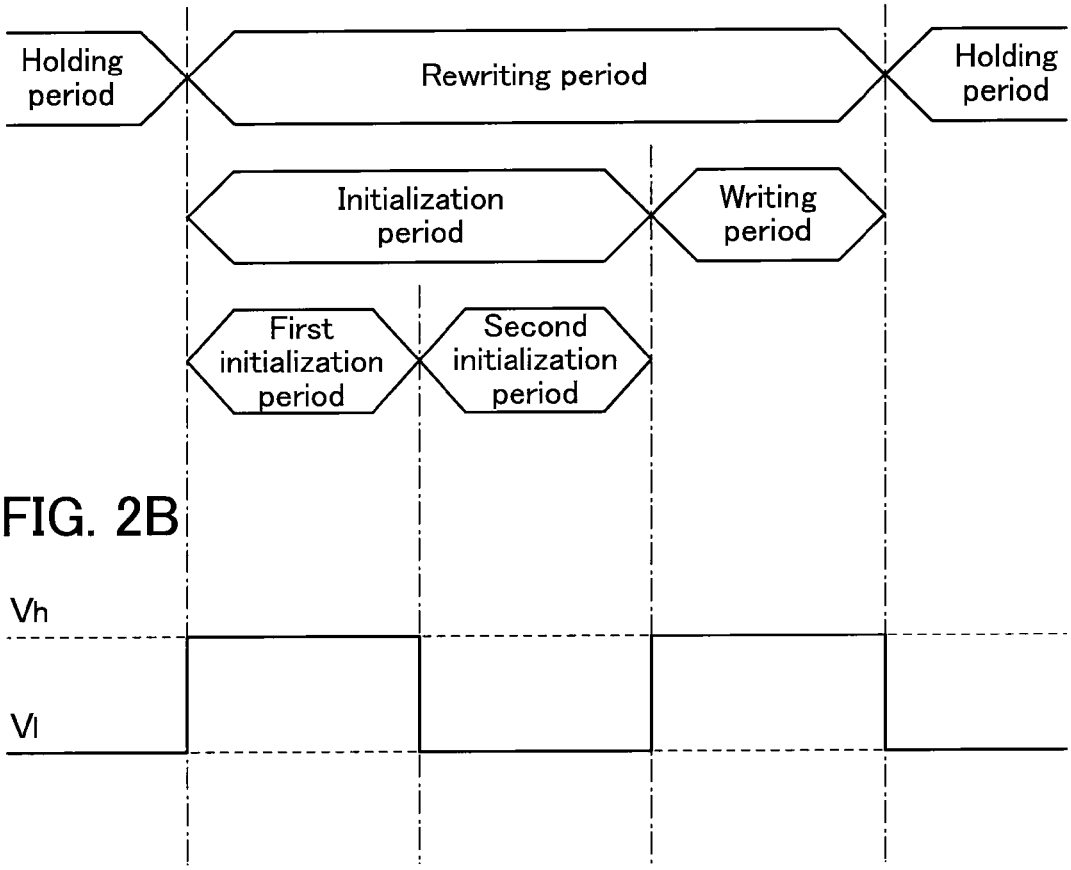
FIGS. 2A and 2B are diagrams each showing a structural example of each period.

That is, the potential of the common electrode and the potential of the pixel electrode are made to be equal to each other in the holding period. In this embodiment, although the potential of the common electrode is $V_1$ and the potential of the pixel electrode is $V_1$ as shown in FIG. 2B, each of the potential of the common electrode and the potential of the pixel electrode may be $V_h$. In addition, after the potentials are made to be equal to each other, it is not necessary to change the potential of the common electrode or the pixel electrode.

Note that, in the holding period, it is not necessary to input a signal substantially; therefore, it is also not necessary to divide the holding period into two periods each of which is the unit time t. In addition, the holding period may be continued until a rewriting period for displaying the next image starts. In the holding period, it is not necessary to change the potential of the common electrode and the potential of the pixel electrode; therefore, in the case where a still image is displayed, power consumption can be sufficiently reduced.

Note that if the holding period is so long, it is possible that the displayed image deteriorates. In such a case, a structure in which operation from the above first initialization period to the writing period is repeated and an image is rewritten may be adopted.

As described above, when the driving method described in this embodiment is adopted, display disorder such as afterimages can be suppressed, and a number of gray scales can be displayed. This can improve the display quality of the display device. At the same time, the power consumption of the display device can be reduced.

Note that if the particles are oppositely charged in the above display device, the gray scales are inverted; however, the basic operation is not changed. In addition, it is possible to exchange the relation of the input potentials.

Note that although the display device which displays three gray scales: the first gray scale (white), the second gray scale (gray), and the third gray scale (black) is described in this embodiment as an example, operation of a display device which displays four or more gray scales is similarly performed. The signal input in the first initialization period may be selected so as to erase the electrical history of the electrophoretic element 118.

Embodiment 2

In this embodiment, operation (a driving method) of a display device which is one embodiment of the disclosed invention is described with reference to FIGS. 5A to 5E. Specifically, a driving method in which first initialization operation is performed in such a manner that periods in a first initialization period are weighted is described taking the case where eight gray scales of a first gray scale (white) to an eighth gray scale (black) are displayed as an example.

Figures 5A, 5B, 5C, 5D, 5E:
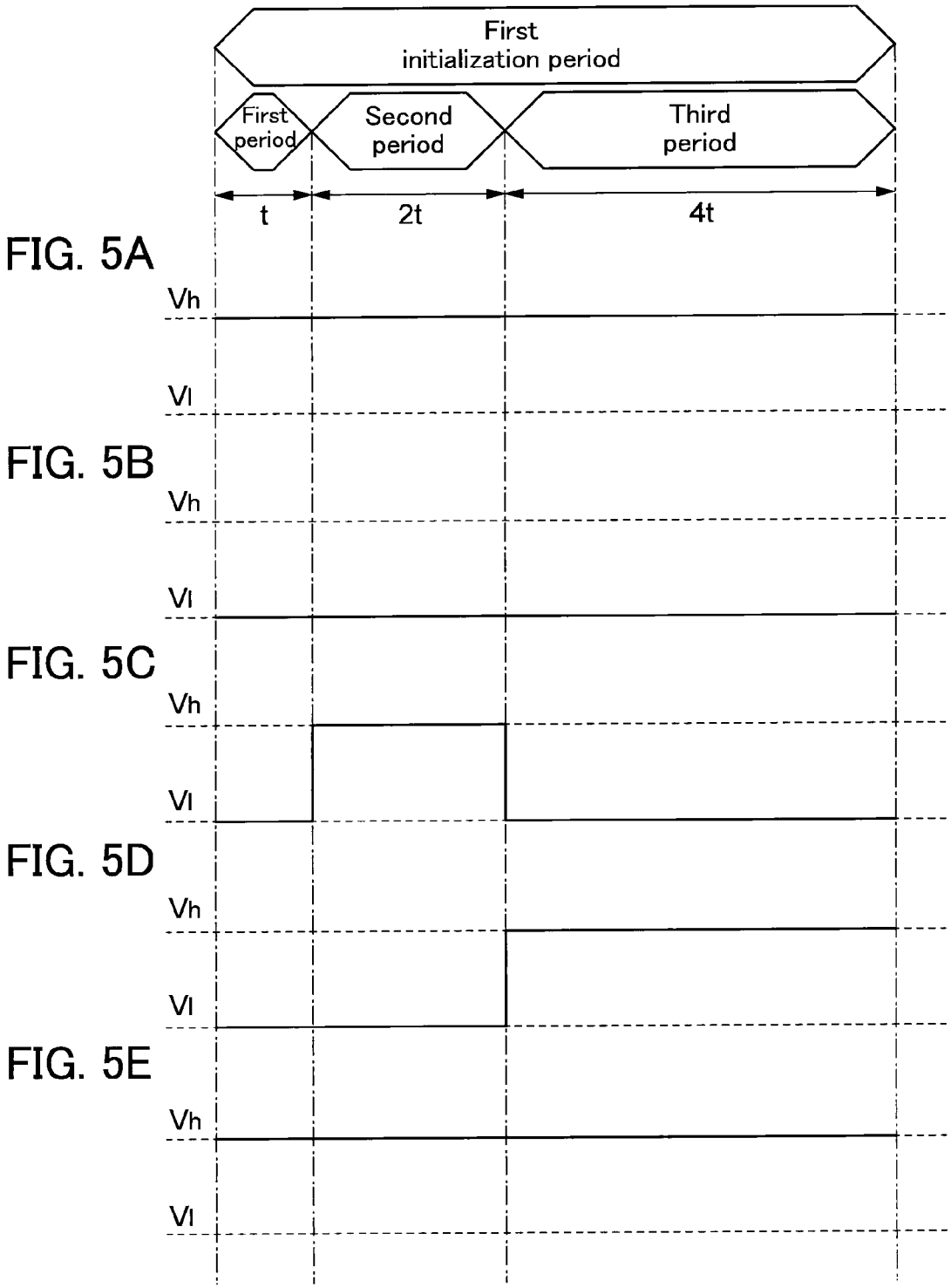
FIGS. 5A to 5E are diagrams each showing an example of an input potential in a first initialization period.

A potential of the common electrode in the first initialization period is $V_h$ as in the above embodiment (see FIG. 5A). In addition, the first initialization period is divided into three periods: a first period (t), a second period (2*t*), and a third period (4*t*). Note that the way to weight the periods is just one example, and another way to weight the periods can be adopted.

The electrophoretic element 118 can display the eighth gray scale (black) by control of an input potential to a pixel electrode in each period in accordance with a gray scale that has been already displayed by the electrophoretic element 118. For example, in the case where the gray scale that the electrophoretic element 118 has already displayed is the first gray scale (white), a potential input to the pixel electrode is $V_1$ in the first period, the second period, and the third period (see FIG. 5B). Thus, a signal of $V_1-V_h$ is input during the unit times 7*t*; therefore, the eighth gray scale (black) is displayed by the electrophoretic element 118.

In addition, in the case where the gray scale that the electrophoretic element 118 has already displayed is the third gray scale for example, a potential input to the pixel electrode is $V_1$ in the first period and the third period; and $V_h$, in the second period (see FIG. 5C). Thus, a signal of $V_1-V_h$ is input during the unit times 5*t*; therefore, the eighth gray scale (black) is displayed by the electrophoretic element 118.

In addition, in the case where the gray scale that the electrophoretic element 118 has already displayed is the fifth gray scale for example, a potential input to the pixel electrode is $V_1$ in the first period and the second period; and $V_h$, in the third period (see FIG. 5D). Thus, a signal of $V_1-V_h$ is input during the unit times 3*t*; therefore, the eighth gray scale (black) is displayed by the electrophoretic element 118.

In addition, in the case where the gray scale that the electrophoretic element 118 has already displayed is the eighth gray scale (black) for example, a potential input to the pixel electrode is $V_h$ in the first period, the second period, and the third period (see FIG. 5E). Thus, a signal is not substantially input; therefore, the eighth gray scale (black) is held.

By weighting the periods in the first initialization period, three-time inputs of the signals can initialize eight gray scales. The number of input of signals can be reduced by weighting the periods as described above; therefore, power consumption can be reduced.

Note that although an example where the periods are weighted in the first initialization period is described above, it is needless to say that weighting can be performed also in the writing period.

This embodiment can be implemented in combination with any of the other embodiments as appropriate.

Embodiment 3

In this embodiment, operation (a driving method) of a display device which is one embodiment of the disclosed invention is described with reference to FIGS. 6A and 6B. Specifically, operation when a period corresponding to the second initialization period in the above embodiment is not provided is described.

In the above embodiment, initialization is performed by provision of the second initialization period after the first initialization period. The second initialization period is an important period in erasing an electrical history of the electrophoretic element; however, after the first initialization period is finished, all the electrophoretic elements in the pixel portion display the same gray scale. Therefore, display can be performed without provision of the second initialization period.

Figure 6A:
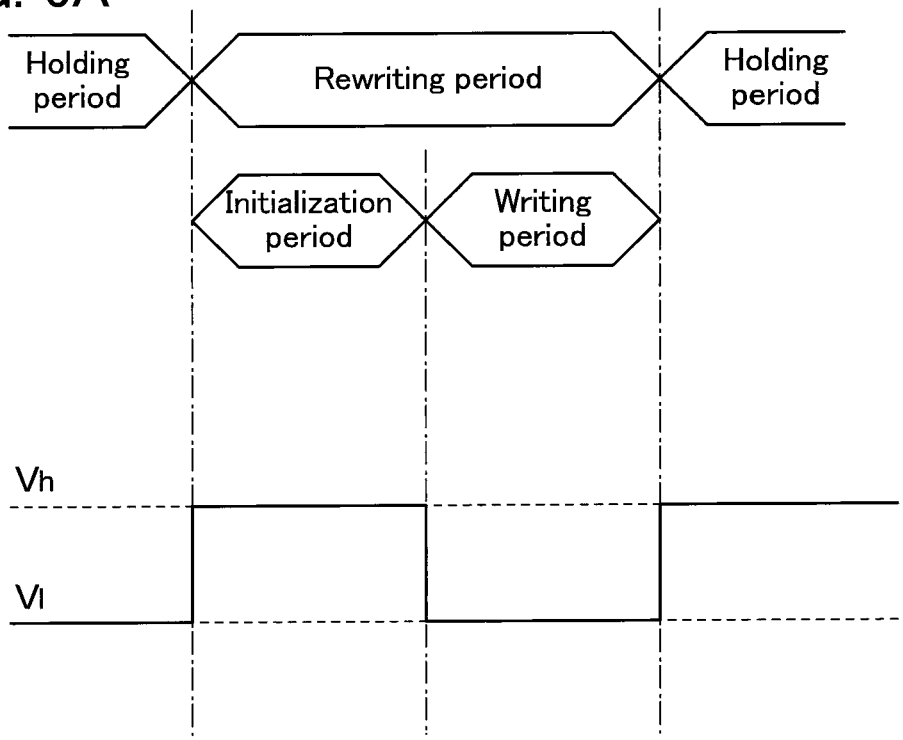
FIGS. 6A and 6B are diagrams each showing a structural example of each period.
Figure 6B:
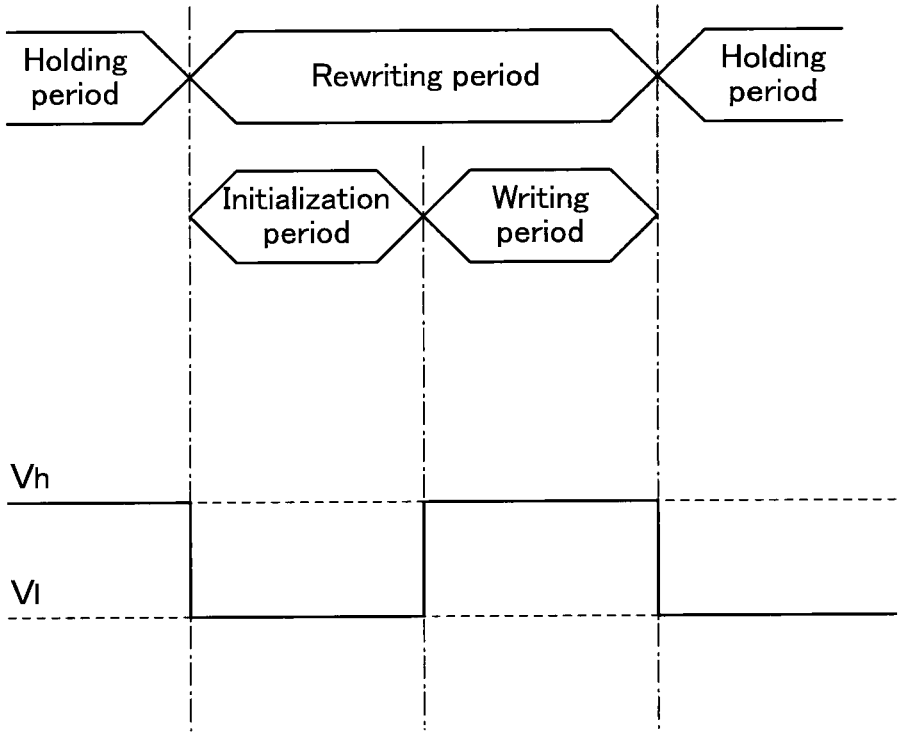

For example, as shown in FIGS. 6A and 6B, a writing period can be provided immediately after an initialization period (a period corresponding to the first initialization period in the above embodiments). Note that potentials of the common electrode in the periods are illustrated below the corresponding periods in FIGS. 6A and 6B.

The operation is roughly described taking structures of FIG. 6A and the above embodiment as examples.

After the initialization period is finished, a third gray scale (black) is displayed by the electrophoretic element. Thus, a signal for changing the gray scale from the third gray scale (black) is selectively input in a subsequent writing period, whereby a gray scale can be displayed as in the first embodiment. For example, when a first gray scale (white) is to be displayed, a potential input to the pixel electrode may be $V_h$ during the unit times 2*t*.

FIG. 6B shows an example of the case where the electrophoretic element displays the first gray scale (white) after the initialization period is finished. In this case, the first gray scale (white) is displayed by the electrophoretic element 118 after the initialization period is finished; therefore, gray scale display can be realized in a subsequent writing period by selectively inputting a signal for changing the gray scale from the first gray scale (white).

Note that the operation in FIG. 6A and the operation in FIG. 6B may be implemented in combination with each other. Thus, initialization using the first gray scale (white) and the third gray scale (black) can be implemented; therefore, an electrical history can be surely erased as compared with the case where only one of the above operations is implemented. In this case, operation where the operations in FIGS. 6A and 6B are alternatively performed can be adopted, for example. Note that in the case where the operations in FIGS. 6A and 6B are combined, frequency of the operation in FIG. 6A and frequency of the operation in FIG. 6B is made to be substantially equal to each other, whereby a sufficient effect can be obtained.

This embodiment can be implemented in combination with any of the other embodiments as appropriate.

Embodiment 4

In this embodiment, a display device which is one embodiment of the disclosed invention is described with reference to FIGS. 7A and 7B. Here, the circuit configuration of a pixel when an erasing transistor is provided is described.

Figure 7A:
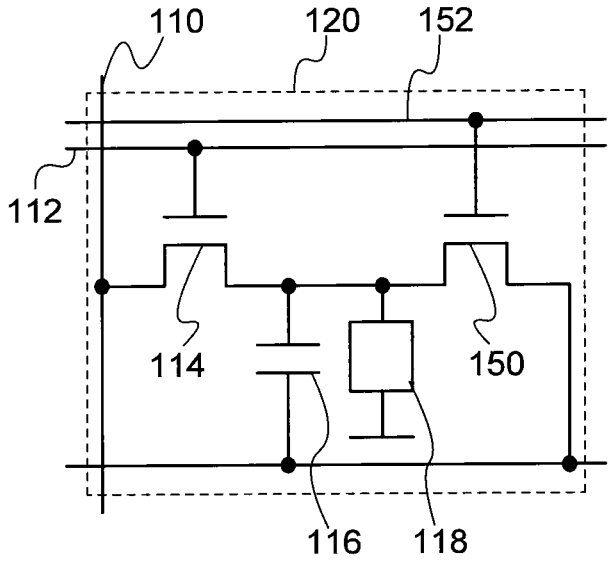
FIGS. 7A and 7B are diagrams each showing a structural example of a pixel circuit.

A configuration illustrated in FIG. 7A corresponds to a configuration of FIG. 1B to which an erasing transistor 150 and an erasing signal line 152 are added. Here, a first terminal (a source terminal) of the erasing transistor 150 is electrically connected to the second terminal (a drain terminal) of the transistor 114, the first terminal of the capacitor 116, and the first terminal (the pixel electrode) of the electrophoretic element 118. In addition, a second terminal (a drain terminal) of the erasing transistor 150 is electrically connected to a wiring (a capacitor wiring) to which a predetermined potential is applied. Additionally, a gate terminal of the erasing transistor 150 is electrically connected to the erasing signal line 152.

The erasing transistor 150 is turned on by a signal from the erasing signal line 152, and a potential of the pixel electrode is equal to the potential of the capacitor wiring. The potential of the capacitor wiring is synchronized with a potential of the common electrode; therefore, a difference between the potential of the pixel electrode and the potential of the common electrode is canceled. This makes it possible to forcibly shorten a time during which a potential difference is generated in the electrophoretic element 118.

Figure 7B:
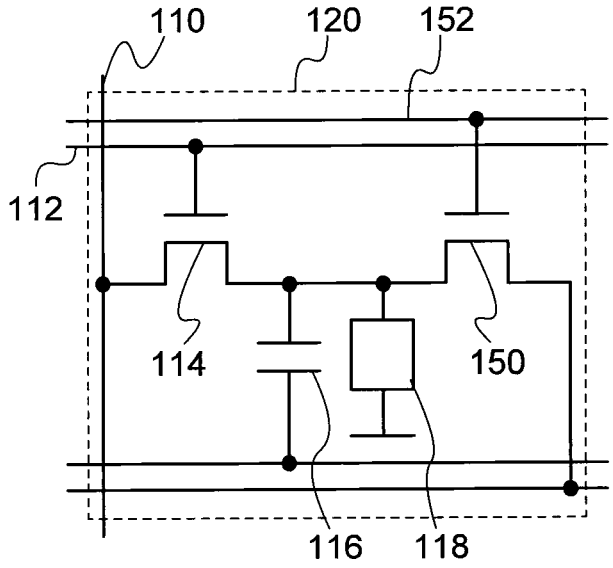

A configuration illustrated in FIG. 7B corresponds to a configuration of FIG. 7A to which a wiring to which an erasing potential is applied is further added. Here, the erasing potential is not particularly limited. The operation in FIG. 7B is similar to the operation of FIG. 7A.

By using the above erasing transistor, a time during which a potential difference is generated in the electrophoretic element 118 can be forcibly shortened. In the case where the number of pixels is increased, a signal-input period can be sufficiently saved. This makes it possible to reduce the drive frequency of a driver and to reduce power consumption.

This embodiment can be implemented in combination with any of the other embodiments as appropriate.

Embodiment 5

In this embodiment, a structural example of a display device to which the above driving method is adopted is described with reference to FIGS. 8A and 8B.

Figure 8A:
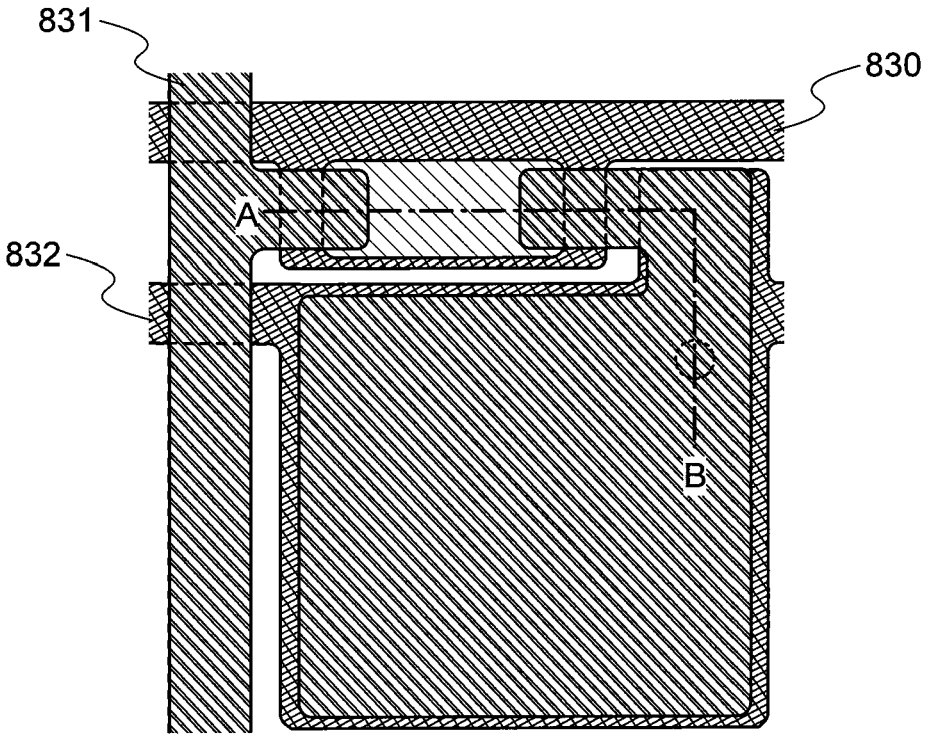
FIGS. 8A and 8B are diagrams showing structural examples of a display device.
Figure 8B:
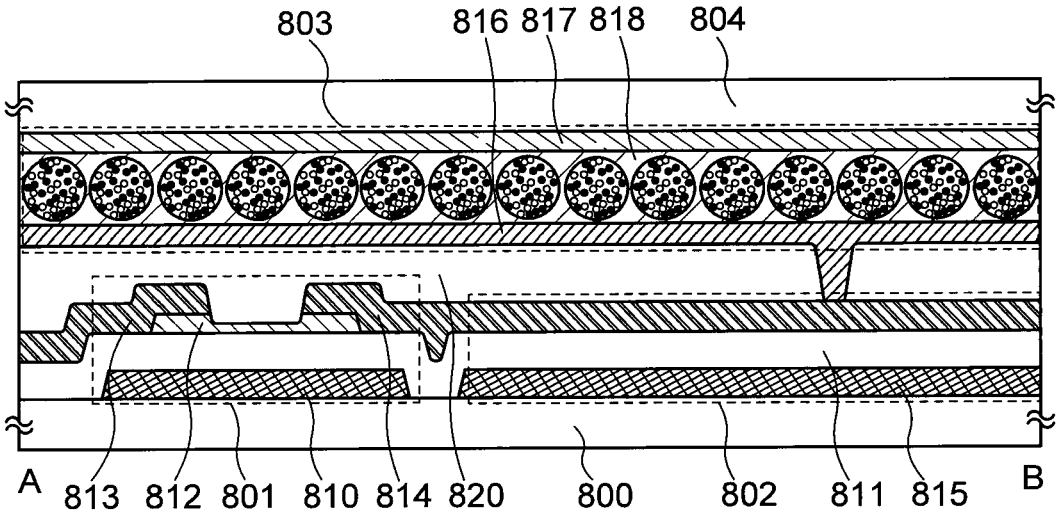

FIG. 8A illustrates a top view of a pixel of a display device in this embodiment, and FIG. 8B illustrates a cross-sectional view along the line A-B in FIG. 8A. The display device illustrated in FIGS. 8A and 8B includes a substrate 800, a transistor 801 and a capacitor 802 formed over the substrate 800, an electrophoretic element 803 formed over the transistor 801 and the capacitor 802, and a light-transmitting substrate 804 formed over the electrophoretic element 803. Note that the electrophoretic element 803 is not illustrated in FIG. 8A for simplicity.

The transistor 801 includes a conductive layer 810, an insulating layer 811 which covers the conductive layer 810, a semiconductor layer 812 formed over the insulating layer 811, a conductive layer 813 and a conductive layer 814 which are in contact with the semiconductor layer 812. Here, the conductive layer 810 functions as a gate electrode of the transistor; the insulating layer 811 functions as a gate insulating layer of the transistor; the conductive layer 813 functions as a first terminal (one of a source terminal and a drain terminal) of the transistor; and the conductive layer 814 functions as a second terminal (the other of the source terminal and the drain terminal) of the transistor.

Additionally, the conductive layer 810 is electrically connected to a gate line 830, and the conductive layer 813 is electrically connected to a source line 831 in the display device. The conductive layer 810 may be integrated with the gate line 830, and the conductive layer 813 may be integrated with the source line 831.

The capacitor 802 includes the conductive layer 814, the insulating layer 811, and a conductive layer 815.

In the display device, the conductive layer 815 is electrically connected to a capacitor wiring 832. The conductive layer 814 functions as one terminal of the capacitor. The insulating layer 811 functions as a dielectric. The conductive layer 815 functions as the other terminal of the capacitor. The conductive layer 815 may be integrated with the capacitor wiring 832.

The electrophoretic element 803 includes a pixel electrode 816, a light-transmitting common electrode 817 (it may be referred to as a counter electrode), and a layer 818 which contains a charged particle and is provided between the pixel electrode 816 and the common electrode 817.

In the display device, the pixel electrode 816 is electrically connected to the conductive layer 814 through an opening formed in an insulating layer 820, and the common electrode 817 is electrically connected to a common electrode of a different pixel. Here, a potential of the common electrode 817 can be changed in synchronization with a potential of the capacitor wiring.

The aforementioned structure makes it possible to control an electric field generated in the layer 818 containing a charged particle, and to control the arrangement of the charged particles in the layer 818 containing a charged particle. In addition, the common electrode 817 and the substrate 804 have light-transmitting properties; therefore, the substrate 804 side functions as a display surface.

Each component of the display device is described in detail below.

As the substrate 800, a semiconductor substrate (e.g., a single crystal silicon substrate or a polycrystalline silicon substrate), an SOI substrate, a glass substrate, a quartz substrate, a conductive substrate whose surface is provided with an insulating layer, a flexible substrate (e.g., a plastic substrate, a bonding film, a base film, or a substrate containing a fiber material (e.g., paper)) or the like can be used.

As a glass substrate, a substrate formed from barium borosilicate glass, aluminoborosilicate glass, soda-lime glass, or the like can be used, for example. As a flexible substrate, a substrate formed from polyethylene terephthalate (PET), polyethylene naphthalate (PEN), polyethersulfone (PES), a resin such as acrylic, polypropylene, polyester, vinyl, polyvinyl fluoride, vinyl chloride, polyamide, or polyimide, an inorganic vapor deposition film, or the like can be used.

For the conductive layer 810, the conductive layer 815, the gate line 830, the capacitor wiring 832, or the like, a single material formed using an element selected from aluminum (Al), copper (Cu), titanium (Ti), tantalum (Ta), tungsten (W), molybdenum (Mo), chromium (Cr), neodymium (Nd), or scandium (Sc); an alloy containing any of these elements; a compound containing any of these elements (an oxide or a nitride); or the like can be used. A stacked structure containing any of these materials can also be used.

As the insulating layer 811, an insulator such as silicon oxide, silicon nitride, silicon oxynitride, silicon nitride oxide, aluminum oxide, or tantalum oxide can be used. A stacked structure of any of these materials can also be used. Note that silicon oxynitride refers to a substance which contains more oxygen than nitrogen and contains oxygen, nitrogen, silicon, and hydrogen at given concentrations ranging from 55 to 65 atomic %, 1 to 20 atomic %, 25 to 35 atomic %, and 0.1 to 10 atomic %, respectively, where the total percentage of atoms is 100 atomic %. Further, the silicon nitride oxide film refers to a film which contains more nitrogen than oxygen and contains oxygen, nitrogen, silicon, and hydrogen at given concentrations ranging from 15 to 30 atomic %, 20 to 35 atomic %, 25 to 35 atomic %, and 15 to 25 atomic %, respectively, where the total percentage of atoms is 100 atomic %.

As the semiconductor layer 812, a semiconductor containing an element belonging to Group 14 of the periodic table, such as silicon (Si) or germanium (Ge), a compound semiconductor such as silicon germanium or gallium arsenide, an oxide semiconductor such as zinc oxide (ZnO) or zinc oxide containing indium (In) and gallium (Ga), a semiconductor containing an organic compound, or the like can be used. A stacked structure of layers formed using any of the above semiconductors can also be used.

In particular, oxide semiconductor materials such as an In—Ga—Zn—O-based oxide semiconductor material, an In—Sn—Zn—O-based oxide semiconductor material, an In—Al—Zn—O-based oxide semiconductor material, a Sn—Ga—Zn—O-based oxide semiconductor material, an Al—Ga—Zn—O-based oxide semiconductor material, a Sn—Al—Zn—O-based oxide semiconductor material, an In—Zn—O-based oxide semiconductor material, a Sn—Zn—O-based oxide semiconductor material, an Al—Zn—O-based oxide semiconductor material, an In—O-based oxide semiconductor material, a Sn—O-based oxide semiconductor material, and a Zn—O-based oxide semiconductor material are preferable because of their semiconductor characteristics and low cost.

A single substance formed using an element selected from aluminum (Al), copper (Cu), titanium (Ti), tantalum (Ta), tungsten (W), molybdenum (Mo), chromium (Cr), neodymium (Nd), or scandium (Sc); an alloy containing any of these elements; a compound containing any of these elements (an oxide or a nitride); or the like can be used as the conductive layer 813, the conductive layer 814, the source line 831, or the like. A stacked structure containing any of these materials can also be used.

As the insulating layer 820, an insulator such as silicon oxide, silicon nitride, silicon oxynitride, silicon nitride oxide, aluminum oxide, or tantalum oxide can be used. In addition, an organic material such as polyimide, polyamide, polyvinyl phenol, benzocyclobutene, acrylic, or epoxy can be used. A siloxane resin, an oxazole resin, or the like can also be used.

As the pixel electrode 816, a single substance formed using an element selected from aluminum (Al), copper (Cu), titanium (Ti), tantalum (Ta), tungsten (W), molybdenum (Mo), chromium (Cr), neodymium (Nd), or scandium (Sc); an alloy containing any of these elements; a compound containing any of these elements (an oxide or a nitride); or the like can be used. Further, a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added can be used. A stacked structure containing any of these materials can also be used.

As the charged particles contained in the layer 818 containing a charged particle, titanium oxide or the like can be used as positively-charged particles, and carbon black or the like can be used as negatively-charged particles. In addition, a single material selected from a conductor, an insulator, a semiconductor, a magnetic material, a liquid crystal material, a ferroelectric material, an electroluminescent material, an electrochromic material, or a magnetophoretic material, or a composite material formed using any of these materials can also be used.

As the common electrode 817, a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added can be used.

As the substrate 804, a light-transmitting substrate typified by a flexible substrate formed using polyethylene terephthalate (PET), acrylic, polyimide, or the like; a quartz substrate; or a glass substrate formed using barium borosilicate glass, aluminoborosilicate glass, soda-lime glass, or the like can be used, for example.

As a substrate 804, a semiconductor substrate (e.g., a single crystal silicon substrate or a polycrystalline silicon substrate), an SOI substrate, a glass substrate, a quartz substrate, a conductive substrate whose surface is provided with an insulating layer, a flexible substrate (e.g., a plastic substrate, a bonding film, a base film, or a substrate containing fiber material (e.g., paper)) or the like can be used.

This embodiment can be implemented in combination with any of the other embodiments as appropriate.

Embodiment 6

In this embodiment, another example of a transistor which can be used for a display device is described with reference to FIGS. 9A to 9D.

In FIGS. 9A to 9D, a transistor 950 is provided over a substrate 900. Additionally, an insulating layer 901 and an insulating layer 902 are provided on/over the transistor 950.

Figure 9A:
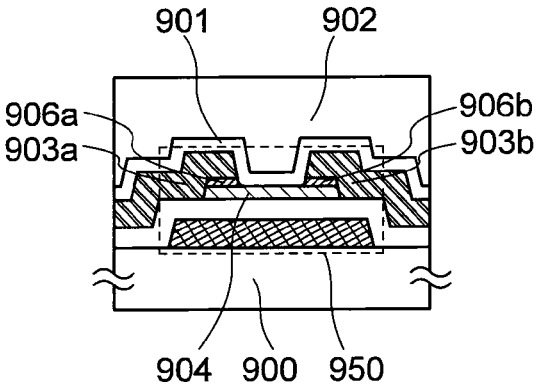
FIGS. 9A to 9D are diagrams each showing a structural example of a display device.

The transistor 950 illustrated in FIG. 9A includes a low resistance semiconductor layer 906*a* between a conductive layer 903*a* which functions as one of a first terminal and a second terminal and a semiconductor layer 904; and a low resistance semiconductor layer 906*b* between a conductive layer 903*b* which functions as the other of the first terminal and the second terminal and the semiconductor layer 904. The existence of the low resistance semiconductor layer 906*a* and the low resistance semiconductor layer 906*b* makes it possible to form an ohmic contact of the conductive layer 903*a* and the conductive layer 903*b* with the semiconductor layer 904. Note that the low resistance semiconductor layer 906*a* and the low resistance semiconductor layer 906*b* have lower resistance than the semiconductor layer 904.

Figure 9B:
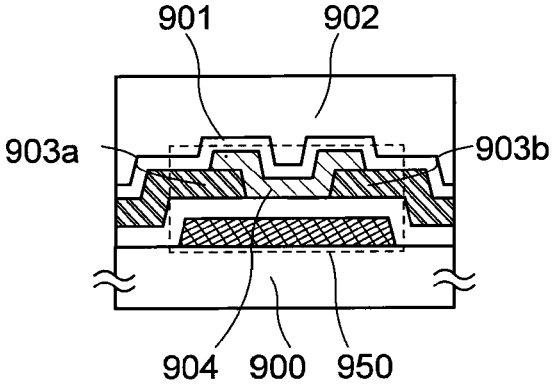

The transistor 950 illustrated in FIG. 9B is a so-called bottom gate transistor and is provided with the semiconductor layer 904 on the conductive layer 903*a* and the conductive layer 903*b*.

Figure 9C:
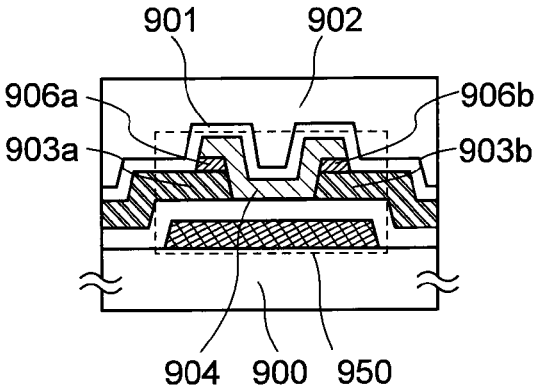

The transistor 950 illustrated in FIG. 9C is a so-called bottom gate transistor and is provided with the semiconductor layer 904 on the conductive layer 903*a* and the conductive layer 903*b*. Further, a low resistance semiconductor layer 906*a* is provided between the conductive layer 903*a* which functions as one of a first terminal and a second terminal and the semiconductor layer 904; and a low resistance semiconductor layer 906*b* is provided between the conductive layer 903*b* which functions as the other of the first terminal and the second terminal and the semiconductor layer 904.

Figure 9D:
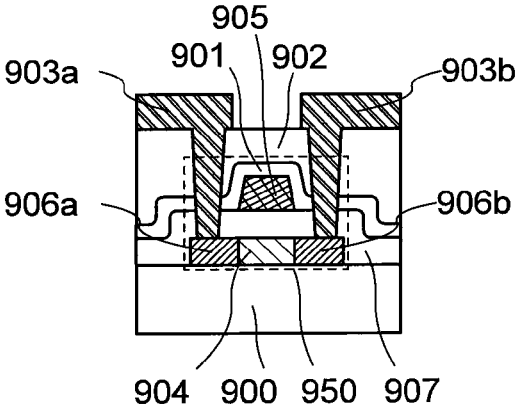

The transistor 950 illustrated in FIG. 9D is a so-called top-gate transistor. Over the substrate 900, an insulating layer 907 is provided over the semiconductor layer 904 including the low resistance semiconductor layer 906*a* and the low resistance semiconductor layer 906*b* each of which functions as a source region or a drain region, and a conductive layer 905 which functions as a gate terminal is provided over the insulating layer 907. In addition, the conductive layer 903*a* which functions as one of a first terminal and a second terminal is provided so as to be in contact with the low resistance semiconductor layer 906*a*, and the conductive layer 903*b* which functions as the other of the first terminal and the second terminal is provided so as to be in contact with the low resistance semiconductor layer 906*b*.

Note that although single-gate transistors are described in this embodiment, a transistor such as a double-gate transistor can be used. In this case, gate terminals (gate electrodes) may be provided above and below the semiconductor layer, or a plurality of gate terminals (gate electrodes) may be provided only on one side of (above or below) the semiconductor layer.

In addition, a material used for the semiconductor layer of the transistor has no particular limitation. Examples of the material used for the semiconductor layer of the transistor will be described below.

As the material used for the semiconductor layer, an amorphous semiconductor deposited by a method such as a vapor deposition method or a sputtering method can be used. As the amorphous semiconductor, amorphous silicon deposited by a vapor deposition method using a semiconductor source gas such as silane is typically used.

In addition, a polycrystalline semiconductor obtained in such a manner that the above amorphous semiconductor is crystallized by optical energy or heat energy, a microcrystal semiconductor (also referred to as a semi-amorphous semiconductor) obtained in such a manner that crystal grains are grown with the use of a deposition condition which is different from that of the amorphous semiconductor, or the like can be used.

In addition, an oxide semiconductor may be used as the material used for the semiconductor layer. Specifically, a material represented by $InMO_3(ZnO)_m$ (m>0) can be used, for example. In the above material, M denotes one or more of metal elements selected from gallium (Ga), iron (Fe), nickel (Ni), manganese (Mn), and cobalt (Co). In addition, the above oxide semiconductor sometimes contains a transition metal element such as iron, nickel, or an oxide of the transition metal element as an impurity element. As such an oxide semiconductor, an In—Ga—Zn—O-based non-single-crystal material or the like can be used.

Additionally, as well as the above oxide semiconductor, any of the following oxide semiconductors can be used: an In—Sn—Zn—O-based oxide semiconductor; an In—Al—Zn—O-based oxide semiconductor; a Sn—Ga—Zn—O-based oxide semiconductor; an Al—Ga—Zn—O-based oxide semiconductor; a Sn—Al—Zn—O-based oxide semiconductor; an In—Zn—O-based oxide semiconductor; a Sn—Zn—O-based oxide semiconductor; an Al—Zn—O-based oxide semiconductor; an In—O-based oxide semiconductor; a Sn—O-based oxide semiconductor; and a Zn—O-based oxide semiconductor.

A transistor formed using the above oxide semiconductor as a semiconductor layer has high field-effect mobility. Therefore, such a transistor can be used not only as a transistor in a pixel portion but also as a transistor included in a gate driver or a source driver. That is, a gate driver or a source driver and a pixel portion can be formed over the same substrate. As a result, manufacturing cost of a display device can be reduced, which is preferable.

This embodiment can be implemented in combination with any of the other embodiments as appropriate.

Embodiment 7

In this embodiment, applications of the display device illustrated in the above embodiment are described with reference to specific examples in FIGS. 10A to 10D.

Figure 10A:
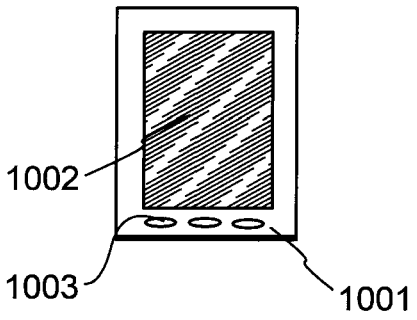
FIGS. 10A to 10D are diagrams each showing an application of a display device.

FIG. 10A shows a portable information terminal, which includes a housing 1001, a display portion 1002, operation buttons 1003, and the like. The display device described in the above embodiment can be applied to the display portion 1002.

Figure 10B:
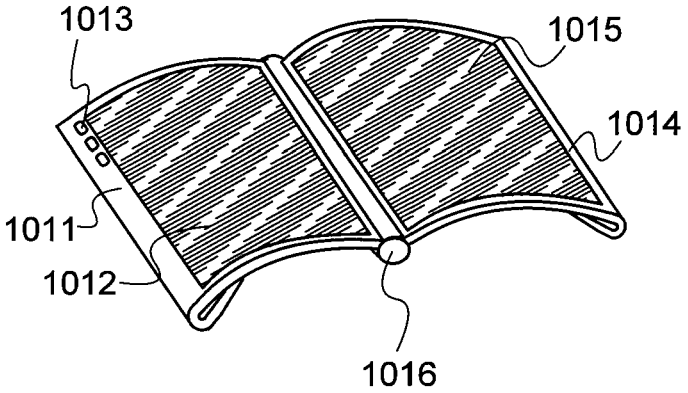

FIG. 10B is an example of an e-book reader on which the display device is mounted described in the above embodiment. A first housing 1011 includes a first display portion 1012 and operation buttons 1013, and a second housing 1014 includes a second display portion 1015. The display device described in the above embodiment can be applied to the first display portion 1012 or the second display portion 1015. In addition, the first housing 1011 and the second housing 1014 can be opened and closed with a support portion 1016. With such a structure, the e-book reader can be handled like a paper book.

Figure 10C:
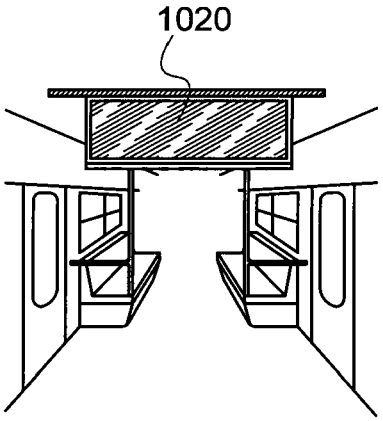

FIG. 10C illustrates a display device 1020 for advertisement in a vehicle. In the case where an advertising medium is printed paper, the advertisement is replaced by hand; however, by using the display device, the advertising display can be changed in a short time with less manpower. In addition, an image can be stably displayed without display deterioration.

Figure 10D:
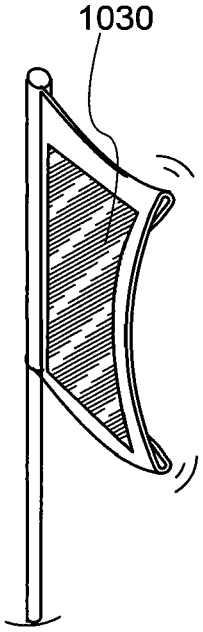

FIG. 10D illustrates a display device 1030 for outdoor advertisement. The display device is manufactured using a flexible substrate and can enhance the advertising effect by being waved.

This embodiment can be implemented in combination with any of the other embodiments as appropriate.

This application is based on Japanese Patent Application serial no. 2009-214963 filed with Japan Patent Office on Sep. 16, 2009, the entire contents of which are hereby incorporated by reference.

What is claimed is:

1. A method for driving a display device comprising a gray scale storage display element wherein the gray scale storage display element comprises a pixel electrode and a common electrode, the method comprising the steps of:

displaying gray by the gray scale storage display element;

displaying black by the gray scale storage display element in a first period by application of a second potential to the pixel electrode and application of the second potential to the common electrode in a first sub-period of the first period and by application of a first potential to the pixel electrode and application of the second potential to the common electrode in a second sub-period of the first period;

displaying white by the gray scale storage display element by application of the second potential to the pixel electrode and application of the first potential to the common electrode in a second period;

displaying a predetermined gray scale by the gray scale storage display element by application of the first potential or the second potential to the pixel electrode and application of the second potential to the common electrode in a third period; and holding the predetermined gray scale by the gray scale storage display element by application of the first potential or the second potential to the common electrode and application of a potential equal to a potential applied to the common electrode to the pixel electrode in a fourth period.

2. The method for driving the display device according to claim 1, wherein the black is displayed by the gray scale storage display element by control of a length of a period during which the first potential is applied to the pixel electrode in accordance with a gray scale held by the gray scale storage display element for displaying an image which is displayed before a predetermined image.

3. The method for driving the display device according to claim 1, wherein the predetermined gray scale is displayed by the gray scale storage display element by control of a length of a period during which the first potential is applied to the pixel electrode, and a length of a period during which the second potential is applied to the pixel electrode.

4. The method for driving the display device according to claim 1, wherein the black is a gray scale with which a brightness of the gray scale storage display element is one of a maximum brightness or a minimum brightness, and wherein the white is a gray scale with which the brightness of the gray scale storage display element is the other of the maximum brightness or the minimum brightness.

5. The display device according to claim 1, wherein a transistor including an oxide semiconductor material is used as an element for controlling a potential applied to the pixel electrode.

6. The display device according to claim 5, wherein the oxide semiconductor material is an In—Ga—Zn—O-based amorphous oxide semiconductor material.

7. A method for driving a display device comprising a gray scale storage display element wherein the gray scale storage display element comprises a pixel electrode and a common electrode, the method comprising the steps of:

display a third gray scale by the gray scale storage display element;

displaying a first gray scale by the gray scale storage display element in a first period by application of a second potential to the pixel electrode and application of the second potential to the common electrode in a first sub-period of the first period and by application of a first potential to the pixel electrode and application of the second potential to the common electrode in a second sub-period of the first period;

displaying a second gray scale by the gray scale storage display element by application of the second potential to the pixel electrode and application of the first potential to the common electrode in a second period;

displaying a predetermined gray scale by the gray scale storage display element by application of the first potential or the second potential to the pixel electrode and application of the second potential to the common electrode in a third period; and holding the predetermined gray scale by the gray scale storage display element by application of the first potential or the second potential to the common electrode and application of a potential equal to a potential applied to the common electrode to the pixel electrode in a fourth period, wherein a brightness of the third gray scale is between a brightness of the first gray scale and a brightness of the second gray scale.

8. The method for driving the display device according to claim 7, wherein the first gray scale is displayed by the gray scale storage display element by control of a length of a period during which the first potential is applied to the pixel electrode in accordance with a gray scale held by the gray scale storage display element for displaying an image which is displayed before a predetermined image.

9. The method for driving the display device according to claim 7, wherein the predetermined gray scale is displayed by the gray scale storage display element by control of a length of a period during which the first potential is applied to the pixel electrode, and a length of a period during which the second potential is applied to the pixel electrode.

10. The method for driving the display device according to claim 7, wherein the first gray scale is a gray scale with which a brightness of the gray scale storage display element is one of a maximum brightness or a minimum brightness, and wherein the second gray scale is a gray scale with which the brightness of the gray scale storage display element is the other of the maximum brightness or the minimum brightness.

11. The display device according to claim 7, wherein a transistor including an oxide semiconductor material is used as an element for controlling a potential applied to the pixel electrode.

12. The display device according to claim 11, wherein the oxide semiconductor material is an In—Ga—Zn—O-based amorphous oxide semiconductor material.

13. A method for driving a display device comprising a gray scale storage display element wherein the gray scale storage display element comprises a pixel electrode and a common electrode, the method comprising the steps of:

displaying a third gray scale by the gray scale storage display element;

displaying a first gray scale in all pixels in a first initialization period by application of a second potential to the pixel electrode and application of the second potential to the common electrode a first sub-period of in the first initialization period and by application of a first potential to the pixel electrode and application of the second potential to the common electrode in a second sub-period of the first initialization period;

displaying a second gray scale in all pixels in a second initialization period by application of the second potential to the pixel electrode and application of the first potential to the common electrode;

displaying a predetermined image in a writing period by application of the first potential or the second potential to the pixel electrode and application of the second potential to the common electrode; and holding the predetermined image in a holding period by application of the first potential or the second potential to the common electrode and application of a potential equal to a potential applied to the common electrode to the pixel electrode, wherein a brightness of the third gray scale is between a brightness of the first gray scale and a brightness of the second gray scale, and wherein the writing period is divided into a plurality of periods of different lengths.

14. The method for driving the display device according to claim 13, wherein the first gray scale is displayed by the gray scale storage display element by control of a length of a period during which the first potential is applied to the pixel electrode in accordance with a gray scale held by the gray scale storage display element for displaying an image which is displayed before the predetermined image.

15. The method for driving the display device according to claim 13, wherein the predetermined image is displayed by the gray scale storage display element by control of a length of a period during which the first potential is applied to the pixel electrode, and a length of a period during which the second potential is applied to the pixel electrode.

16. The method for driving the display device according to claim 13, wherein the first gray scale is a gray scale with which a brightness of the gray scale storage display element is one of a maximum brightness or a minimum brightness, and wherein the second gray scale is a gray scale with which the brightness of the gray scale storage display element is the other of the maximum brightness or the minimum brightness.

17. The display device according to claim 13, wherein a transistor including an oxide semiconductor material is used as an element for controlling a potential applied to the pixel electrode.

18. The display device according to claim 17, wherein the oxide semiconductor material is an In—Ga—Zn—O-based amorphous oxide semiconductor material.

* * * * *